US006315687B1

(12) United States Patent
Todd et al.

(10) Patent No.: US 6,315,687 B1
(45) Date of Patent: Nov. 13, 2001

(54) ADJUSTABLE SHUTTLECOCK

(76) Inventors: Troy A. Todd, 11525 Rochester Ave. #101, Los Angeles, CA (US) 90025; Phong T. Tran, 3505 Keystone Ave., West Los Angeles, CA (US) 90034

( * ) Notice: Subject to any disclaimer, the term of this patent is extended or adjusted under 35 U.S.C. 154(b) by 0 days.

(21) Appl. No.: 09/226,806

(22) Filed: Jan. 6, 1999

(51) Int. Cl.[7] ..... A63B 67/18
(52) U.S. Cl. ..... 473/579
(58) Field of Search ..... 473/579, FOR 217

(56) References Cited

U.S. PATENT DOCUMENTS 4,995,619 * 2/1991 Hwang ..... 473/579 X
5,265,886 * 11/1993 Hum ..... 473/579

FOREIGN PATENT DOCUMENTS

25803 * 12/1905 (GB) ..... 473/FOR 217
22138 * 10/1906 (GB) ..... 473/FOR 217
4606 * 2/1913 (GB) ..... 473/FOR 217

* cited by examiner

*Primary Examiner*—John A. Ricci
(74) *Attorney, Agent, or Firm*—Tope-McKay & Associates

(57) ABSTRACT

An adjustable shuttlecock including means for attaching and detaching an interchangeable tail and a head including an interchangeable weight portion and an interchangeable springing mechanism. The springing mechanism and tail may be designed in such a way as to allow for proprietary designs and logos to be added to them. Additionally, the shuttlecock is designed from durable materials, which will help provide the shuttlecock with a very long life-span. Furthermore, the shuttlecock's spring may be constructed in such a manner as to cause a noise to be made upon compression.

20 Claims, 4 Drawing Sheets

ADJUSTABLE SHUTTLECOCK

TECHNICAL FIELD

The present invention relates to sporting equipment, and more particularly to a shuttlecock including interchangeable components and which may be struck by the foot, knee, or other parts of the body as well as paddles and other equipment.

BACKGROUND OF THE INVENTION

This invention is directed to amusements and sporting equipment generally, and more particularly to a shuttlecock designed to be struck with the foot, knee, or other parts of the body as well as by paddles and other equipment.

The typical shuttlecock used in badminton is a small plastic piece with a rubber head; however, other larger shuttlecocks have been proposed in the past for play without a racket, see e.g. U.S. Pat. Nos. 5,265,886 and 2,911,219, wherein shuttlecocks are disclosed having heads from a series of plastic spring-like portions and paper sheets, respectively. The present invention is an improvement over the prior shuttlecocks because it allows for interchangeable and adjustable springing mechanisms, an adjustable weight for adjusting the shuttlecock's center of gravity, and interchangeable tail portions, thereby providing a shuttlecock which is user-adjustable to allow for various configurations depending on the desired play characteristics.

SUMMARY OF THE PRESENT INVENTION

A shuttlecock of simple and durable construction designed for fitness, including a shaft to which are attached an interchangeable and adjustable springing mechanism which allows one to adjust the amount by which the shuttlecock bounces from an impact, and an interchangeable weight which allows the shuttlecock's center of gravity to be adjusted. Additionally, the shuttlecock is designed such that it has an easily interchangeable tail portion which provides the option of using a variety of tails, such as plastic or rubber blades, feathers, streamers, etc. The shuttlecock is designed to be hit by any portion of the body or by a paddle or racket as necessary for a particular game.

Accordingly, the primary object of the invention is to provide a shuttlecock for kicking, hitting, or striking with either one's body or with a paddle or racket which has an adjustable and interchangeable springing mechanism, an interchangeable weight portion, and an interchangeable tail portion.

Other objects and advantages will be come apparent in the following specification when considered in light of the attached drawings.

DETAILED DESCRIPTION

Figure 1:
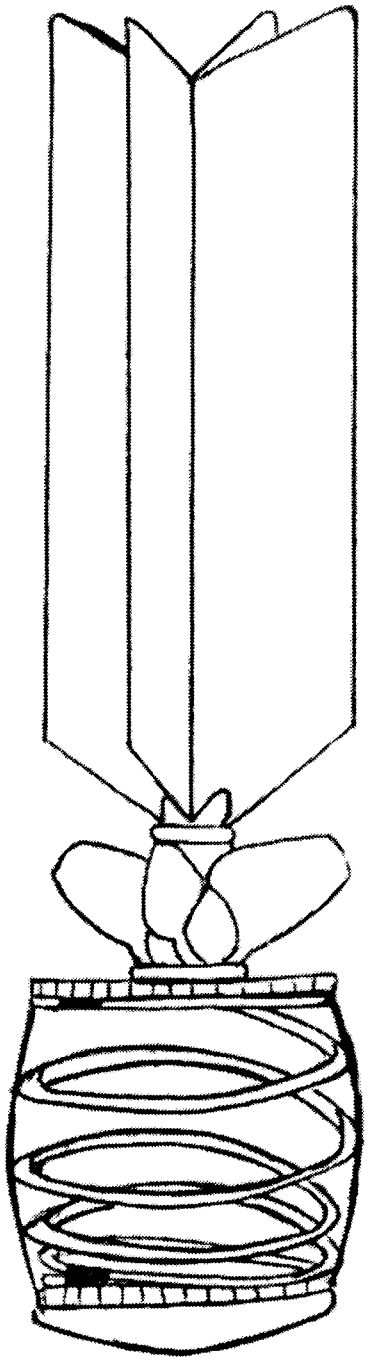
FIG. 1 is a front view of a fully assembled embodiment of the invention utilizing a clear casing, a coil-type springing means, and a series of tail fins.
Figure 2:
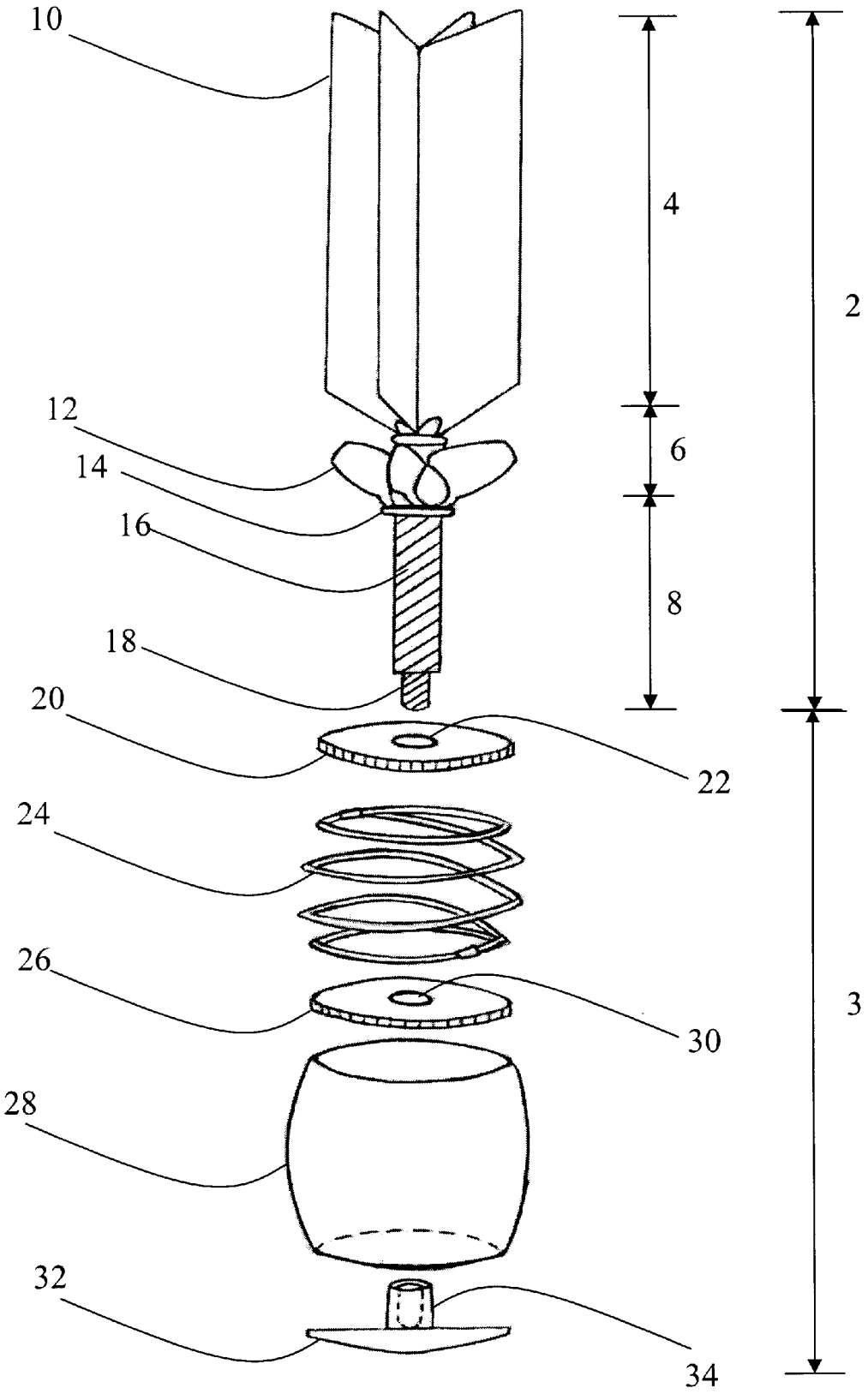
FIG. 2 is an exploded front view of an embodiment of the invention.

The shuttlecock of the present invention is displayed in an assembled fashion in FIG. 1, and in an exploded view in FIG. 2 with its components identified. The shuttlecock of the invention is constructed from a number of individual pieces, generally including a shaft 2 and a head 3. The shaft 2 includes a tail portion 4, a mid-portion 6, and an end portion 8. The tail portion 4 of the shaft 2 includes a guidance means 10, designed to impart desired aerodynamic qualities to the shuttlecock. Examples of different guidance means are demonstrated in FIG. 4. Possible guidance means include many possible configurations, only a few of which are shown. Additional configurations could include such items as streamers, tassels, varying shapes, etc. By providing an adjustable guidance means, a user may, for example, choose a configuration which causes the shuttlecock to spiral or to fall straight without spinning. Configurations may be chosen based on the provision of a desirable flight characteristic, or simply for aesthetic appeal. The mid-portion 6 of the shuttlecock includes a mid-knob portion 12 and a retaining portion 14. The mid-knob 12 may be designed as a weight to adjust the center of gravity of the shuttlecock, as a means of enhancement to the aerodynamic qualities of the shuttlecock, or purely for aesthetic appeal. The retaining portion 14 of the mid-portion 6 of the shaft 2 is positioned next to the end portion 8 of the shaft 2, providing a means for keeping the various parts of the head 3 fixedly attached to the end portion 8 of the shaft 2. The end portion 8 of the shaft 2 includes a top attachment portion 16, which may optionally be unthreaded, partially threaded, or fully threaded on the portion abutting the retaining portion 12. The end portion 8 also includes a bottom-attachment portion 18 opposite the retaining portion 12 on the end portion 8. The head parts 3 include an annular adjustable top 20, which includes a center hole 22. The annular adjustable top 20 is formed such that the end portion 8 of the shaft 2 can be slid through the center hole 22, so that the annular adjustable top 20 may abut the retaining portion 14. The center hole 22 may also include threads and/or a frictional material to allow it to be threadably and/or frictionally attached and adjustable on the top-attachment portion 16 of the shaft 2. The remaining head parts include a springing means 24, an annular weight 26, an optional casing 28, and a tip 34. The springing means 24 is designed to fit around the end portion 8 of the shaft 2 and to abut the annular adjustable top 20. The springing means 24 may take various forms such as an annular coil spring, an elastic springing means such as foam, or a series of springing plates or pillow-like elements. The annular weight 26 includes a center hole 30, designed to fit around the top attachment portion 16 of the shaft 2, and has a large enough radius to abut the springing means 24. The optional casing 28 covers the springing means 24 and the annular weight 26 in a circumferential manner so as to prevent the springing means from pinching or otherwise hurting a user. The optional casing 28 may be designed of a soft, flexible, and non-fatiguing material such as plastic, elastic, etc. to prevent interference with the operation of the springing mechanism 24. The tip 32 may include an attachment means 34 whereby it may be attached to the bottom-attachment portion 18 of the shaft 2. For a particular configuration of the attachment means 34 of the tip 32, the bottom-attachment portion 18 of the shaft 2 includes a corresponding element to allow attachment. Examples of attachment means include snaps and threading schemes where the attachment means 34 may be male or female threaded and the bottom-attachment portion 18 may be female or male threaded, respectively to form a proper fit. Typically, the tip 34 is constructed of a soft rubber or foam material to minimize the chance of bodily injury to the user. It is also desirable, though not necessary, to choose component sizes for all parts of the invention to prevent the possibility of eye injury. By providing an attachable/detachable tip, the annular weight 26 may be interchanged to adjust the desired weight of the head 3 and to adjust the center of gravity of the adjustable shuttlecock. Furthermore, the springing means 24 may also be interchanged to provide different spring options for varying the amount of bounce the adjustable shuttlecock has upon impact. The optional casing 28 may also be interchanged to provide for different designs, etc. Finally, all of the parts of the head 3 may be interchanged to provide different geometric configurations for the head 3. For example, a group of head 3 components may provide for a square shape, or a cylindrical shape of greater or lesser diameter. The tension on the spring means 24 may be adjusted by varying the gap between the annular adjustable top 20 and the tip 34. Depending on the particular configuration, this may be accomplished either through an adjustment of the annular adjustable top 20 relative to the top-attachment portion 16 or of the tip 34 relative to the bottom-attachment portion 18. The threaded or other adjustment means of either may be varied to allow for greater or lesser compressibility of the spring means 24 upon impact.

Figure 3:
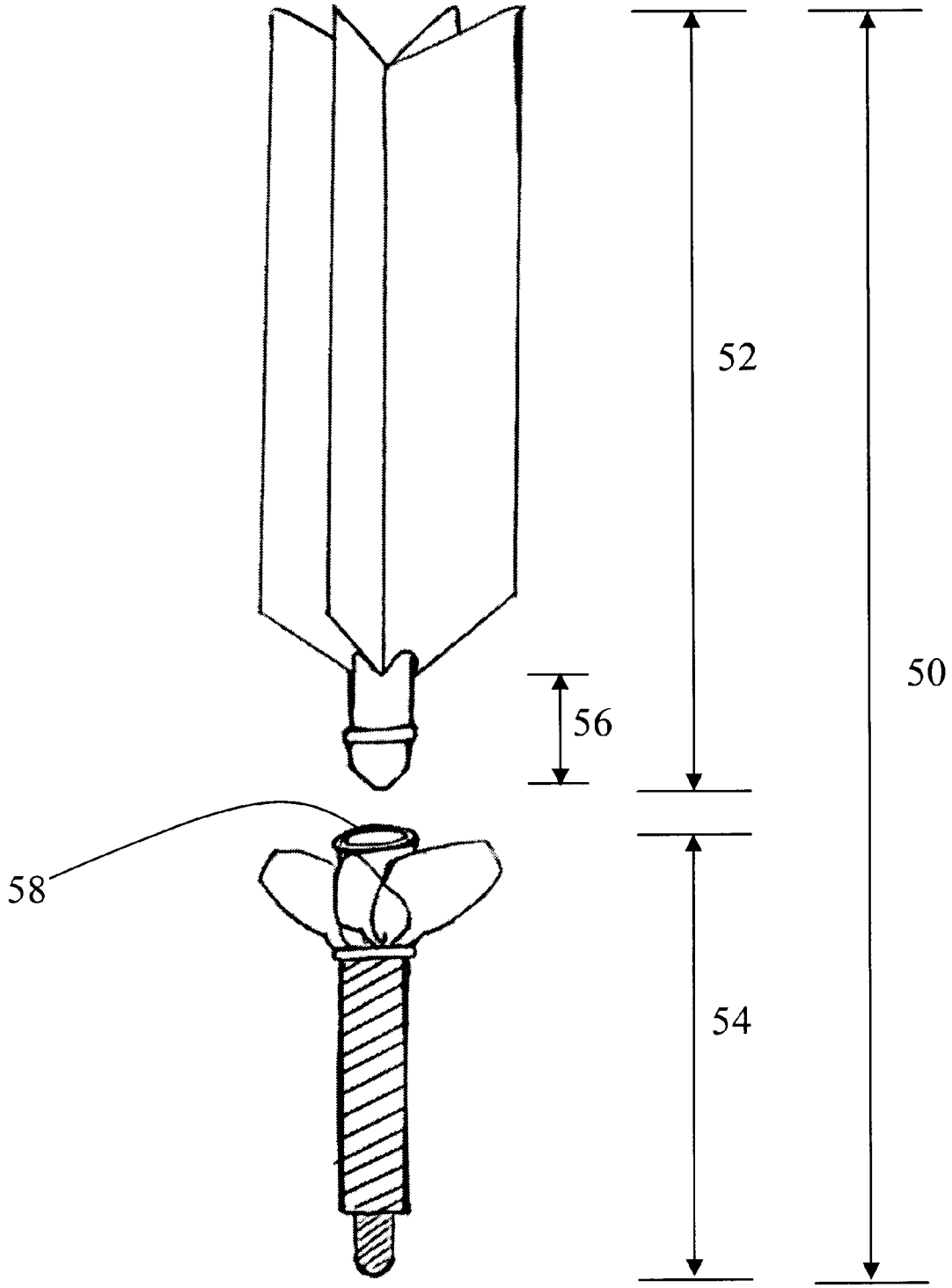
FIG. 3 is an exploded view of the shaft and tail of an embodiment of the invention in which the tail portion of the shaft is detachable and interchangeable.

FIG. 3 is an exploded view of the shaft 50, in which the shaft 50 includes an interchangeable tail portion 52 and a body portion 54. The body portion 54 of the shaft 50 includes parts directly analogous in both form and function to parts 12, 14, 16, and 18 of FIG. 2, and additionally includes a body-to-tail attachment means 58. The interchangeable tail portion 52 is directly analogous in both form and function to that of the tail portion 4 of FIG. 2, and additionally includes a tail-to-body attachment means 56. The body-to-tail attachment means 58 of body portion 54 and the tail-to-body attachment means 56 of the interchangeable tail portion 52 provide the means whereby the body portion 54 and the interchangeable tail portion 52 may be detachably and rigidly attached such that they structurally act as the equivalent of a single-piece shaft 2 as in FIG. 2. The means of attachment may take such forms as male/female threads or interlocking snapping means.

Figure 4:
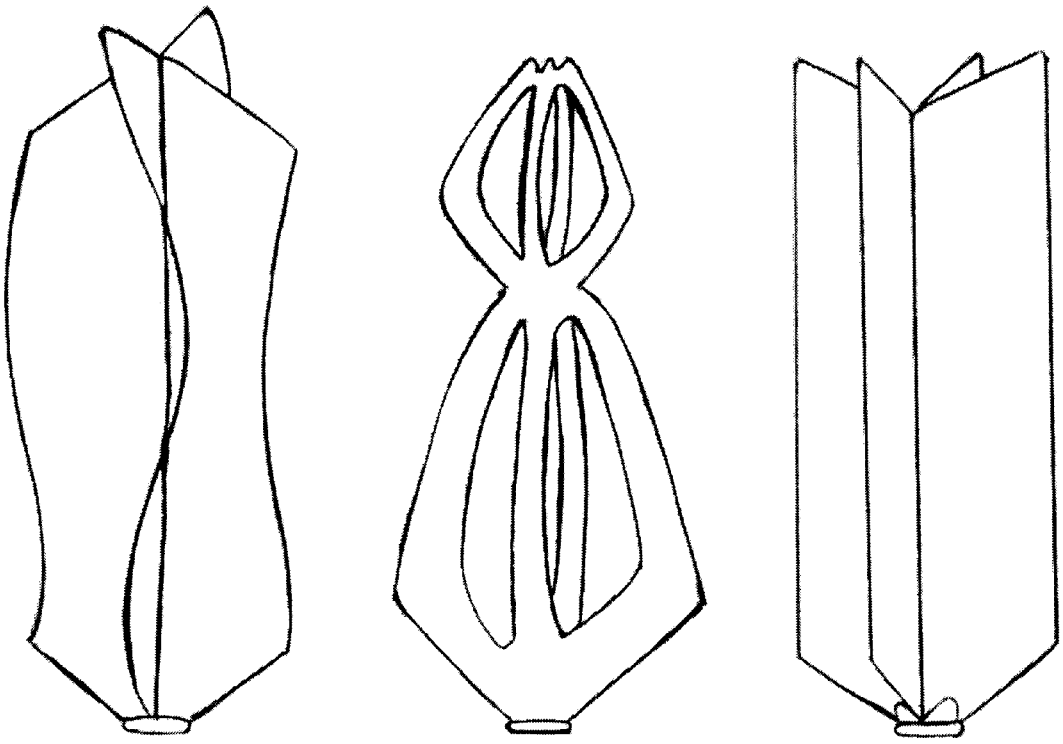
FIG. 4 provides examples of different tail portions, each of which import different flight characteristics upon the shuttlecock.

Examples of different tail portions are demonstrated in FIG. 4, each of which import different flight or aesthetic characteristics upon the shuttlecock. The materials used in the guidance means of the tail portions may include plastics, cloth, paper, etc. The tail portions shown a nd other tail portions may be formed as part of a singular shaft or as part of an interchangeable tail portion.

Figure 5:
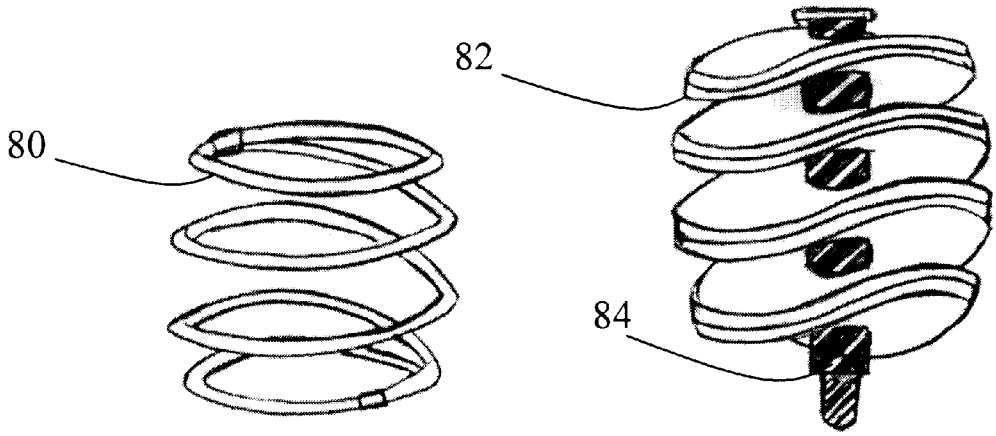
FIG. 5 is a front view of two examples of springing means which may be utilized in the invention.

Two examples of possible embodiments for the springing means are demonstrated in FIG. 5. An annular coil springing means 80 is shown without the shaft, and an annular plate springing means 82 is shown with the top-attachment portion of the shaft 84. In the embodiment using an annular plate springing means 82, the plates may either be substantially flat or substantially wavy depending on the particular configuration desired. Other embodiment of the springing means than those shown are anticipated, such as the use of a foam core, etc.

The foregoing descriptions of the preferred embodiments of the invention have been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An adjustable shuttlecock for use in exercising or games which includes, a shaft including, a tail portion having a guidance means integral thereto;

a mid-portion adjacent to the tail portion, including a mid-knob and a retaining portion having a retaining portion radius, the mid-knob and the retaining portion positioned such that the mid-knob lies between the retaining portion and the tail portion;

an end portion adjacent to the mid-portion, positioned such that the mid-portion lies between the tail portion and the end portion, the end portion including a top-attachment portion, having a top-attachment portion radius, formed adjacent to the retaining portion of the mid-portion and a bottom-attachment portion, formed adjacent to the top-attachment portion, the retaining portion radius being greater than the top-attachment portion radius;

a head including, an annular adjustable top having a annular adjustable top center hole, the annular adjustable top having an annular adjustable top radius and the annular adjustable top center hole having an annular adjustable top center hole radius, the annular adjustable top center hole radius being greater than the top-attachment portion radius, and the annular adjustable top center hole radius being smaller than the retaining portion radius, so that the annular adjustable top may frictionally slide over the top-attachment portion of the shaft and may abut the retaining portion of the shaft;

a springing means slidably fitting around the top-attachment portion of the shaft and abutting the annular adjustable top;

a tip having an attachment means, the attachment means chosen such that the tip may be detachably and rigidly attached to the bottom attachment portion of the shaft, the tip chosen such that the springing means of the head may be compressed and held between the tip and the annular adjustable top, the tip being fabricated from a flexible material such that the springing portion of the head may be compressed upon the tip impacting an object and provide a bouncing action.

2. An adjustable shuttlecock as set forth in claim 1, wherein, the mid-portion and the end portion of the shaft comprise a body portion, said mid-knob of said end portion further including a body-to-tail attachment means;

the tail portion of the shaft comprises an interchangeable tail portion further including a tail-to-body attachment means formed adjacent to the guidance means and positioned such that it may operatively connect with the body-to-tail attachment means of the mid-knob of the end portion such that the body portion and the interchangeable tail portion of the shaft may be connected and disconnected to allow the shaft to have interchangeable tail portions.

3. An adjustable shuttlecock as set forth in claim 2, wherein said head portion further includes an annular weight including an annular weight center hole, said annular weight center hole having an annular weight center hole radius, said annular weight center hole radius being larger than the top-attachment portion radius of the shaft such that the annular weight may slide over the top-attachment portion and reside between said springing means and said tip, thereby providing means by which the annular weight may be varied to change the center-of-gravity characteristics of the adjustable shuttlecock.

4. An adjustable shuttlecock as set forth in claim 2, wherein said head portion further includes an optional casing, the optional casing circumferentially residing about the springing means to prevent damage to the springing means and to prevent injury to the user of the adjustable shuttlecock due to pinching or other reasons.

5. An adjustable shuttlecock as set forth in claim 2, wherein the tail-to-body attachment means and the body-to-tail attachment means include means for threadably attaching and detaching.

6. An adjustable shuttlecock as set forth in claim 2, wherein the tail-to-body attachment means and the body-to-tail attachment means include means for snapably attaching and detaching.

7. An adjustable shuttlecock as set forth in claim 2, wherein the guidance means consists of a plurality of highly flexible tassels.

8. An adjustable shuttlecock as set forth in claim 1, wherein said head portion further includes an annular weight including an annular weight center hole, said annular weight center hole having an annular weight center hole radius, said annular weight center hole radius being larger than the top-attachment portion radius of the shaft such that the annular weight may slide over the top-attachment portion and reside between said springing means and said tip, thereby providing means by which the annular weight may be varied to change the center-of-gravity characteristics of the adjustable shuttlecock.

9. An adjustable shuttlecock as set forth in claim 8, wherein the annular adjustable top, the springing means, the annular weight, and the tip are removably attached to the shaft such that they may be interchanged to provide for different configurations of the adjustable shuttlecock.

10. An adjustable shuttlecock as set forth in claim 1, wherein said head portion further includes an optional casing, the optional casing circumferentially residing about the springing means to prevent damage to the springing means and to prevent injury to the user of the adjustable shuttlecock due to pinching or other reasons.

11. An adjustable shuttlecock as set forth in claim 1, wherein the bottom-attachment portion of the shaft and the attachment means of the tip of the head further include means for threadably attaching and detaching.

12. An adjustable shuttlecock as set forth in claim 1, wherein the bottom-attachment portion of the shaft and the attachment means of the tip of the head further include means for snapably attaching and detaching.

13. An adjustable shuttlecock as set forth in claim 1, wherein the springing means is a coil spring.

14. An adjustable shuttlecock as set forth in claim 1, wherein the springing means is a plurality of annular plates.

15. An adjustable shuttlecock as set forth in claim 14, wherein the annular plates are fabricated from plastic.

16. An adjustable shuttlecock as set forth in claim 14, wherein the annular plates are fabricated from aluminum.

17. An adjustable shuttlecock as set forth in claim 14, wherein the annular plates are substantially non-planar.

18. An adjustable shuttlecock as forth in claim 1, wherein the annular adjustable top center hole further includes threads, the top-attachment portion includes a threaded portion adjacent to the retaining portion of the mid-portion, the threads of the center hole and the threads of the top-attachment portion being fabricated such upon rotation, the annular adjustable top will compress or decompress the springing means against the tip, thereby adjusting the tension on the springing means and causing the adjustable shuttlecock to bounce more or less upon impact.

19. An adjustable shuttlecock as set forth in claim 1, wherein the springing means is designed such that it emits a noise upon impact.

20. An adjustable shuttlecock as set forth in claim 1, wherein the attachment means of the tip of the head includes a threaded portion and the bottom-attachment portion of the shaft includes threads, said threaded portion of said head and the threads of the bottom-attachment portion being selected such that the tip may be rotatably and threadably adjusted, thereby compressing or decompressing the springing means against the annular adjustable top, thereby adjusting the tension on the springing means and causing the adjustable shuttlecock to bounce more or less upon impact.

* * * * *